US005720860A

United States Patent [19]

Sekhar et al.

[11] Patent Number: 5,720,860

[45] Date of Patent: Feb. 24, 1998

[54] MICROPYRETICALLY-PRODUCED COMPONENTS OF ALUMINUM PRODUCTION CELLS

[75] Inventors: Jainagesh A. Sekhar; Hao Zhang, both of Cincinnati, Ohio

[73] Assignee: Moltech Invent S. A., Luxembourg, Luxembourg

[21] Appl. No.: 122,448

[22] PCT Filed: Apr. 19, 1993

[86] PCT No.: PCT/US93/03605

§ 371 Date: Jul. 27, 1995

§ 102(e) Date: Jul. 27, 1995

[87] PCT Pub. No.: WO94/24321

PCT Pub. Date: Oct. 7, 1994

[51] Int. Cl.[6] ..... C25C 3/08; H01B 1/02; B05D 3/02

[52] U.S. Cl. ..... 204/243 R; 427/314; 252/512; 204/290 R

[58] Field of Search ..... 204/290 R, 243 R, 204/244–247; 427/314; 252/512

[56] References Cited

U.S. PATENT DOCUMENTS 5,310,476 5/1994 Sekhar et al. ..... 204/294 X
5,378,327 1/1995 Sekhar et al. ..... 204/243 R X

*Primary Examiner*—Donald R. Valentine
*Attorney, Agent, or Firm*—Dinsmore & Shohl, LLP

[57] ABSTRACT

Components of aluminium production cells made of composite materials comprising ordered aluminide compounds of at least one of nickel, iron and titanium, for use in particular as anodes and cathodes and cell linings in aluminium production cells containing a fluoride-based molten electrolyte containing dissolved alumina and cerium species, are produced by micropyretic reaction of a reaction mixture comprising compacted particulate reactants which react to produce the composite material. The reaction mixture is mixed with a cerium-based colloidal carrier, dried and compacted into a reaction body bonded by the cerium-based colloidal carrier, and the colloid-bonded reaction body is ignited to initiate the micropyretic reaction. One preferred reaction mixture comprises 50 to 90 parts by weight of particulate nickel, 5 to 30 parts by weight of particulate aluminium, 5 to 25 parts by weight of particulate copper and 0 to 15 parts by weight of additives selected from chromium, manganese, vanadium, molybdenum, zirconium, niobium and cerium and compounds thereof, as well as compounds of aluminium, nickel, iron, titanium and copper.

40 Claims, No Drawings

MICROPYRETICALLY-PRODUCED COMPONENTS OF ALUMINUM PRODUCTION CELLS

FIELD OF THE INVENTION

This invention relates to components of aluminium production cells made of composite materials comprising ordered aluminide compounds of nickel, iron and/or titanium, for use in particular as anodes and cathodes and cell linings in aluminium production cells containing a fluoride-based molten electrolyte containing dissolved alumina and cerium species.

The invention is more particularly concerned with the production of components of aluminium production cells made of composite materials comprising ordered aluminide compounds of nickel, iron and/or titanium, by the micropyretic reaction of a mixture of reactive powders, which reaction mixture when ignited undergoes a micropyretic reaction to produce a net-shaped reaction product, it being understood that the reaction product may be used directly as an anode or cathode, or as substrate carrying an outer protective coating, or as a cell component.

BACKGROUND ART

U.S. Pat. No. 4,614,569 describes anodes for aluminium-production coated with a protective coating of cerium oxyfluoride, formed in-situ in the cell or pre-applied, this coating being maintained by the addition of cerium to the molten cryolite electrolyte. The inclusion of cerium in the substrate was proposed to promote formation of the cerium oxyfluoride coating and enhance its properties, but so far no practical way was found to effectively implement this.

U.S. Pat. No. 4,948,676 describes a ceramic/metal composite material for use as an anode for aluminium production particularly when coated with a protective cerium oxyfluoride based coating, comprising mixed oxides of cerium and one or more of aluminium, nickel, iron and copper in the form of a skeleton of interconnected ceramic oxide grains interwoven with a metallic network of an alloy or an intermetallic compound of cerium and one or more of aluminium, nickel, iron and copper. The production methods included reactive sintering, reactive hot-pressing and reactive plasma spraying of a metal powder mix optionally including some oxides. The described process conditions led to a complex porous microstructure which through dissolution and redeposition of cerium provided a self-healing effect when the anode is first used. However, difficulties were encountered in controlling the porosity of this microstructure.

U.S. Pat. No. 4,909,842 discloses the production of dense, finely grained composite materials with ceramic and metallic phases by self-propagating high temperature synthesis (SHS) with the application of mechanical pressure during or immediately after the SHS reaction. The ceramic phase may be carbides or borides of titanium, zirconium, hafnium, tantalum or niobium, silicon carbide or boron carbide. The intermetallic phase may be aluminides of nickel, titanium or copper, titanium nickelides, titanium ferrites or cobalt titanides, and the metallic phase may include aluminium, copper, nickel, iron or cobalt. The final product, which has ceramic grains in an intermetallic and/or metallic matrix, has a density of at least about 95% of the theoretical density obtained by the application of pressure. Interconnected porosity is not obtained, nor does the process control porosity. Because the pressure is applied uniaxially, it is not possible to produce a net-shaped article, i.e. whose final shape and dimensions may be largely or even completely achieved in the manufacturing process, and for which no or only minor post manufacturing processing such as grinding are required. Also, the required application of pressure prevents high production rates. Moreover, materials produced by the described method but without the application of pressure are weak and have a porosity of about 45 to 48%, which makes them unsuitable as electrodes for aluminium production.

PCT patent application WO/13977 describes the production of ceramic or ceramic-metal electrodes for electrochemical processes, in particular for aluminium production, by combustion synthesis of particulate or fibrous reactants with particulate or fibrous fillers and binders. The reactants included aluminium usually with titanium and boron; the binders included copper and aluminium; the fillers included various oxides, nitrides, borides, carbides and silicides. The described composites included copper/aluminium oxide-titanium diboride etc. This method has prospects of improved process control leading to a better microstructure, but the compositions are still in need of improvement.

PCT patent application WO/92/22682 describes an improvement of the just mentioned production method with specific fillers. The described reactants included an aluminium nickel mixture, and the binder could be a metal mixture including aluminium, nickel and up to 5 weight % copper. Among the many combinations covered is a combination of 85–90 weight % nickel-aluminium-copper with 10–15 weight % of cerium oxide. However, such combinations are very reactive and the described method does not provide details as to how to control the microstructure.

U.S. Pat. No. 5,310,476 discloses the production of a protective refractory coating on carbonaceous and other substrates by applying to the substrate a micropyretic reaction layer from a slurry containing particulate reactants in a colloidal carrier, and initiating a micropyretic reaction. This application is specially concerned with the production of refractory borides coatings suitable for cathodic applications.

So far, attempts to produce an electrode suitable as anode for aluminium production and based on intermetallic compounds of aluminium with nickel, iron and/or titanium have not been successful. Additionally, no combination of such intermetallics with a ceramic has been achieved which maintains the property of a ceramic to resist oxidation at the same time achieving good conductivity at high temperatures. Moreover, attempts to incorporate cerium in an anode substrate to be coated with cerium oxyfluoride have not been successful.

SUMMARY OF THE INVENTION

The invention provides a method of manufacturing components of aluminium production cells made of composite materials comprising ordered aluminide compounds of nickel, iron and/or titanium, for use in particular as anodes and cathodes and cell linings in aluminium production cells containing a fluoride-based molten electrolyte containing dissolved alumina and cerium species, by micropyretic reaction of a reaction mixture comprising reactants which react to produce the aluminide-based composite material, which reaction mixture when ignited undergoes a micropyretic reaction.

According to the invention, the reaction mixture is mixed with a cerium-based colloidal carrier, dried and compacted into a reaction body bonded by the cerium-based colloid, and the colloid-bonded reaction body is ignited to initiate the micropyretic reaction. The use of a cerium-based colloidal carrier—usually colloidal ceria or cerium acetate, usually in an aqueous medium—has been found to assist bonding of the reaction mixture to form the reaction body, and contributes to moderating the micropyretic reaction as well as considerably improving the properties of the reaction product. Comparable reaction mixtures without the cerium-based colloidal carrier are difficult to bond, react poorly and do not produce a satisfactory product.

Moreover, the cerium-based colloid improves the reaction product, in particular when it is to be used as an anode for aluminium production coated with a protective cerium oxyfluoride coating. When such anode is initially immersed in a cerium-containing fluoride-based electrolyte, the colloid-originating cerium in the anode promotes initial cerium oxyfluoride formation and improves the impermeability of the cerium oxyfluoride coating by its dissolution and redeposition, which provides a self-healing effect. These effects are enhanced When the composite material of the anode also contains copper oxide. The colloid-originating cerium in the composite material also improves its performance when used as cathode or cell lining in an aluminium production cell with a cerium-containing fluoride-based electrolyte.

The cerium-based colloidal carrier may comprise colloidal ceria, colloidal cerium acetate or mixtures thereof. These cerium-based colloids may also include some colloidal silica, alumina, yttria, thoria, zirconia, magnesia, lithia or monoaluminium phosphate, and hydroxides, acetates and formates thereof as well as oxides and hydroxides of other metals, cationic species and mixtures thereof. Some particulate ceria can be included in the colloidal ceria.

The cerium-based colloid may be derived from colloid precursors and reagents which are solutions of at least one salt such as chlorides, sulfates, nitrates, chlorates, perchlorates or metal organic compounds such as alkoxides, formates, acetates The aforementioned solutions of metal organic compounds, principally metal alkoxides, may be of the general formula $M(OR)_z$ where M is a metal or complex cation, R is an alkyl chain and z is a number usually from 1 to 12.

The dry colloid content of the cerium-based colloidal carrier usually corresponds to 10–30 weight % of the colloidal carrier, preferably 10–20 weight %, but may account for up to 40 weight % or even 50 weight % of the colloidal carrier, there being preferably from 10 to 20 ml of the colloidal carrier per 100 grams of the powder mixture.

The colloid-originating cerium usually amounts to 0.2 to 10% by weight of the composite material.

The reaction mixture usually comprises particulate metals from the group of aluminium, nickel, iron, titanium, copper, chromium, manganese, vanadium, molybdenum, zirconium, niobium and cerium, and/or compounds of these metals, and mixtures thereof.

A typical reaction mixture comprises 50 to 100 parts by weight of particulate nickel, iron and/or titanium and 2 to 50 parts by weight of particulate aluminium. There may also be a further 1 to 30 parts by weight of particulate additives selected from copper, chromium, manganese, vanadium, molybdenum, zirconium, niobium and cerium and compounds thereof, as well as compounds of aluminium, nickel, iron and titanium.

One preferred reaction mixture comprises 50 to 100 parts by weight of particulate nickel, 2 to 50 parts by weight of particulate aluminium and 1 to 25 parts by weight of particulate copper. Another comprises 50 to 90 parts by weight of particulate nickel, 5 to 30 parts by weight of particulate aluminium, 5 to 25 parts by weight of particulate copper and 0 to 15 parts by weight of additives selected from chromium, manganese, vanadium, molybdenum, zirconium, niobium and cerium and compounds thereof, as well as compounds of aluminium, nickel, iron, titanium and copper.

For some applications, especially for anodes, the reaction mixture includes one or more oxides of at least one metal from the group of aluminium, nickel, copper, chromium, manganese and cerium.

For cathodic applications, the reaction mixture may comprise at least one boride of at least one metal from the group titanium, chromium, vanadium, molybdenum, zirconium, niobium and cerium, or precursors that react to form said borides.

The micropyretic reaction (also called self-propagating high temperature synthesis) can be initiated by applying local heat to one or more points of the reaction body by a convenient heat source such as an electric arc, electric spark, flame, welding electrode, microwaves or laser, in which case the reaction propagates through the reaction body along a reaction front which may be self-propagating or assisted by a heat source. Reaction may also be initiated by heating the entire body to initiate reaction throughout the body in a thermal explosion mode. In either case, the reaction proceeds without supplying further heat as in a furnace. The reaction atmosphere is not critical, and reaction can take place in ambient conditions without the application of pressure.

A coating may be applied to the component produced by micropyretic reaction, the composition of this coating depending on the intended use. Such coatings may in general contain the same components as the additives listed above.

A preferred coating for aluminium-production anodes is cerium oxyfluoride according to U.S. Pat. No. 4,614,569, formed in-situ in the cell or pre-applied. The cerium oxyfluoride may optionally contain additives such as compounds of tantalum, niobium, yttrium, tantalum, praesodymium and other rare earth elements, this coating being maintained by the addition of cerium and possibly other elements to the molten cryolite electrolyte. When a cerium oxyfluoride coating is to be applied in-situ, the anode substrate preferably includes cerium or cerium oxide as an additive in the composite material, in addition to the cerium from the colloidal carrier. Production of such a coating in-situ leads to dense and homogeneous cerium oxyfluoride. The presence of copper oxide in the anode surface is believed to enhance the cerium oxyfluoride coating.

A cathode according to the invention can also be coated with a protective refractory coating, typically containing an aluminium-wettable Refractory Hard Metal compound such as the borides and carbides of metals of Group IVB (titanium, zirconium, hafnium) and Group VB (vanadium, niobium, tantalum). Boride-containing coatings are preferred.

Such a protective coating may be formed by applying to the cathode a micropyretic reaction layer from a slurry containing particulate reactants in a colloidal carrier, and initiating a micropyretic reaction as described in co-pending application Ser. No. 07/861,513, the contents whereof are incorporated herein by way of reference. Such a micropyretic slurry comprises particulate micropyretic reactants in combination with optional particulate or fibrous non-reactant fillers or moderators in a carrier of colloidal materials or other fluids such as water or other aqueous solutions, organic carriers such as acetone, urethanes, etc., or inorganic carriers such as colloidal metal oxides.

When the cathode is coated with a refractory coating forming a cathodic surface in contact with the cathodically-produced aluminium, it can be used as a drained cathode, the refractory coating forming the cathodic surface on which the aluminium is deposited cathodically, and the component being arranged usually upright or at a slope for the aluminium to drain from the cathodic surface.

Advantageously, before use, the operative surface of the cell component is conditioned by impregnating it with colloidal ceria or cerium acetate or other colloids such as colloidal silica, alumina, yttria, thoria, zirconia, magnesia or lithia followed by drying the colloid-impregnated electrode, these impregnation/drying steps being repeated preferably until the electrode surface is saturated with the colloid. Impregnation of the component should be followed by a heat treatment and is preferably also preceded by a heat treatment. For anodes used in molten salt electrolysis, coated or not with cerium oxyfluoride, this impregnation preferably takes place with colloidal ceria or cerium acetate.

The invention also pertains to a cell component of an aluminium production cell, made of a composite material comprising at least one ordered aluminide compound of at least one of nickel, iron and titanium. The cell component is produced by micropyretic reaction of a dried reaction mixture comprising compacted particulate reactants which react to produce the composite material, bonded by a cerium-based colloidal carrier. Cerium from the colloid is dispersed in the aluminide compound forming the cell component. Usually, the colloid-originating cerium amounts to 0.2 to 10% by weight of the composite material.

A preferred composite material making up the cell component comprises nickel aluminide in solid solution with copper, and possibly also in solid solution with other metals and oxides. Another composite material comprises a major amount of $Ni_3Al$ and minor amounts of NiAl, nickel, a ternary nickel-aluminium-copper intermetallic compound and $CeO_2$.

Other composite materials comprise at least one intermetallic compound from the group AlNi, $AlNi_3$, $Al_3Fe$, $AlFe_3$, AlTi and $AlTi_3$ as well as ternary intermetallic compounds derived therefrom, and solid solutions and mixtures of at least one of said intermetallic compounds with at least one of the metals aluminium, nickel, iron, titanium, copper, chromium, manganese, vanadium, molybdenum, zirconium, niobium and cerium and oxides of said metals.

Another composite material comprises an intimate mixture of at least one intermetallic compound of nickel-aluminium, at least one intermetallic compound of nickel-aluminium-copper, copper oxide, and a solid solution of at least two of the metals nickel, aluminium and copper.

The component produced by the micropyretic reaction may comprise an intimate mixture of at least one intermetallic compound of nickel-aluminium such as $Ni_3Al$ and $Al_3Ni$, at least one intermetallic compound of nickel-aluminium-copper such as $Al_{73}Ni_{18}Cu_9$, copper oxide, and a solid solution of two or three metals nickel, aluminium and copper. It is believed that this material and materials like it contain non-stoichiometric conductive oxides wherein lattice vacancies are occupied by the metals or intermetallics, providing an outstanding conductivity while retaining the property of ceramic oxides to resist oxidation.

The aforementioned nickel aluminide based materials and nickel aluminide composites and solid solutions have been found to perform particularly well as dimensionally stable anodes for aluminium production.

As explained above, the cell component is advantageously impregnated with colloidal ceria, cerium acetate, silica, alumina, yttria, thoria, zirconia, magnesia or lithia.

Another aspect of the invention is a precursor of a component of an aluminium production cell which is ignitable to produce by micropyretic reaction a cell component made of a composite material comprising at least one ordered aluminide compound of at least one of nickel, iron and titanium. This precursor is a body formed of a dried reaction mixture, as explained above, comprising compacted particulate reactants which react to produce the composite material, mixed with and bonded by a cerium-based colloidal carrier. The properties of this precursor are substantially enhanced by the cerium-based colloid.

Yet another aspect of the invention is a reaction mixture for producing a component of an aluminium production cell, which component is made of a composite material comprising at least one ordered aluminide compound of at least one of nickel, iron and titanium, by micropyretic reaction of the reaction mixture after drying and compacting. The reaction mixture comprises particulate reactants, as set out above, which react to produce the composite material, mixed with a cerium-based colloidal carrier in an amount of at least 5 ml of colloid per 100 grams of the reaction mixture.

DETAILED DESCRIPTION

The invention will be further described in the following examples.

EXAMPLE 1

A powder mixture was prepared from nickel powder, −100 mesh, aluminium powder, −325 mesh, and copper powder, −200 mesh. First the nickel and aluminium powders were mixed in a ratio Ni:Al 87:13 wt %. Then this mixture was mixed with copper powder in a ratio Ni/Al:Cu 90:10 wt % in 12 ml of colloidal cerium acetate per 100 grams of the powder mixture.

After 10 minutes mixing, which was sufficient to produce a good mixture, the mixture was compacted into samples by applying a pressure of about 170 MPa for 2–3 minutes, and allowed to dry in air for at least 3 hours. When the sample was almost dry, an exothermic reaction between the powders and cerium acetate occurred. To keep the samples cool and avoid cracking, cool air was blown on the samples by an air gun.

After the samples had dried completely, a small hole was drilled in the bottom of each sample to threadably receive a nickel-based superalloy rod to provide for electrical connection to the sample.

The samples were then combusted in a furnace at 900° C. to initiate a micropyretic reaction which swept through the sample, and afterwards allowed to cool slowly to avoid cracking.

EXAMPLE 2

Example 1 was repeated varying the proportion of Ni:Al, in the ratios 75:25; 86.6:13.4; 90:10; 92:8; 94:6 and 96:4. The weight ratio of Ni/Al:Cu was kept constant at 90:10. Colloidal cerium acetate was added to the different series of samples in amounts of 12 ml, 24 ml and 36 ml per 100 grams of powder mixture. Compacting was carried out at approx. 170 MPa for 4 minutes. After drying, the samples were combusted in a furnace at 950° C. All samples underwent a micropyretic reaction.

EXAMPLE 3

A sample prepared as in Example 1 was conditioned for use as an aluminium electrowinning anode by heating in air at 1000° C. for 4 hours to oxidize its surface. After cooling, the sample was dipped in colloidal cerium acetate until no more is absorbed. The sample was then heated in an oven to dry it. After cooling the sample was again dipped in colloidal cerium acetate and dried. The dipping and drying steps were repeated until no more cerium acetate was absorbed.

EXAMPLE 4

A cylindrical piece of 25 mm diameter and 40 mm height was prepared using the micropyretic technique of Example 2, with the composition Ni:Al 86.6:13.4, mixed with colloidal cerium acetate in an amount of 24 ml/100 grams of the powder mixture. The material was then submitted to a heat treatment in air at 1000° C. for 10 hours. The weight uptake due to oxidation was about 6%. The oxidized material was impregnated by dipping into a colloidal solution of cerium acetate for 10 minutes and drying at 250° C. This operation was repeated twice. The sample was then tested as an anode in a small electrolytic cell containing molten cryolite at 1000° C. with 5% alumina and 1.5% cerium fluoride, at a current density of 0.3 $A/cm^2$ for 4 hours. The cell voltage remained stable at 4V during the test. The test anode was then cross-sectioned and no significant corrosion was observed.

EXAMPLE 5

The same pretreatment and test procedures were applied to a second sample with the composition Ni:Al 90:10 mixed with colloidal cerium acetate in an amount of 24 ml per 100 grams of the powder mixture. The test results were similar to the previous material.

EXAMPLE 6

The same pretreatment and test procedures were applied to a third sample with the composition Ni:Al 90:10 but mixed with colloidal cerium acetate in an amount of 36 ml per 100 grams of the powder mixture. The weight uptake after the heat treatment was more important (about 20% greater) but the material did not show any crack or fissure. The electrolytic test gave results similar to the previous examples with a somewhat higher cell voltage of 5 Volts.

EXAMPLE 7

The previous examples were repeated varying the size of the particulate nickel (1 to 10 micrometer diameter), copper (1 to 100 micrometer diameter) and aluminium (1 to 100 micrometer diameter). Best results in terms of lowest porosity and electrochemical performance were obtained with nickel 3 micrometer diameter, copper 10 micrometer diameter and aluminium 44 micrometer diameter (–325 mesh).

EXAMPLE 8

The previous examples were repeated replacing the colloidal cerium acetate with colloidal ceria optionally containing some ceria powder. Excellent results were obtained.

We claim:

1. A method of manufacturing components of aluminum production cells made of composite materials comprising ordered aluminide compounds of at least one of nickel, iron and titanium, by micropyretic reaction of a reaction mixture comprising compacted particulate reactants which react to produce the composite material, wherein the reaction mixture is mixed with a cerium-based colloidal carrier, direct and compacted into a reaction body bonded by the cerium-based colloidal carrier, and the colloid-bonded reaction body is ignited to initiate the micropyretic reaction, wherein the cerium originating from the colloid ranges from 0.2 to 10% by weight of the composite material.

2. The method of claim 1, wherein the cerium-based colloidal carrier comprises at least one of colloidal ceria and colloidal cerium acetate.

3. The method of claim 2, wherein the cerium-based colloidal carrier further comprises at least one of colloidal alumina, yttria, silica, thoria, zirconia, magnesia, lithia or monoaluminium phosphate.

4. The method of claim 2, wherein the cerium-based colloidal carrier is derived from colloid precursors and reagents which are solutions of at least one salt such as chlorides, sulfates, nitrates, chlorates, perchlorates or metal organic compounds such as alkoxides, formates, acetates and mixtures thereof.

5. The method of claim 4, wherein the solutions of metal organic compounds, principally metal alkoxides, are of the general formula $M(OR)_z$ where M is a metal or complex cation, R is an alkyl chain and z is a number usually from 1 to 12.

6. The method of claim 2, wherein the cerium-based colloidal carrier has a dry colloid content corresponding to up to 50 weight % of the colloidal carrier, preferably from 10 to 20 weight %, there being from 10 to 20 ml of the colloidal carrier per 100 grams of the reaction mixture.

7. The method of claim 1, wherein the reaction mixture comprises particulate metals or compounds of metals selected from the group consisting of aluminium, nickel, iron, titanium, copper, chromium, manganese, vanadium, molybdenum, zirconium, niobium and cerium, and mixtures thereof.

8. The method of claim 7, wherein the reaction mixture comprises 50 to 100 parts by weight of at least one of particulate nickel, iron and titanium and 2 to 50 parts by weight of particulate aluminium.

9. The method of claim 8, wherein the reaction mixture further comprises 1 to 30 parts by weight of particulate additives selected from copper, chromium, manganese, vanadium, molybdenum, zirconium, niobium and cerium and compounds thereof as well as compounds of aluminium, nickel, iron and titanium.

10. The method of claim 9, wherein the reaction mixture comprises 50 to 100 parts by weight of particulate nickel, 2 to 50 parts by weight of particulate aluminium and 1 to 25 parts by weight of particulate copper.

11. The method of claim 10, wherein the reaction mixture comprises 50 to 90 parts by weight of particulate nickel, 5 to 30 parts by weight of particulate aluminium, 5 to 25 parts by weight of particulate copper and 0 to 15 parts by weight of additives selected from chromium, manganese, vanadium, molybdenum, zirconium, niobium and cerium and compounds thereof as well as compounds of aluminium, nickel, iron, titanium and copper.

12. The method of claim 9, wherein the reaction mixture comprises at least one oxide of at least one metal from the group of aluminium, nickel, copper, chromium, manganese and cerium.

13. The method of claim 9, wherein the reaction mixture comprises at least one boride of at least one metal from the group titanium, chromium, vanadium, zirconium, niobium and cerium, or precursors that react to form said borides.

14. The method of claim 1, wherein the composite material comprises at least one intermetallic compound from the group AlNi, $AlNi_3$, $Al_3Fe$, $AlFe_3$, AlTi and $AlTi_3$ as well as ternary intermetallic compounds derived therefrom, and solid solutions and mixtures of at least one of said intermetallic compounds with at least one of the metals aluminium, nickel, iron, titanium, copper, chromium, manganese, vanadium, molybdenum, zirconium, niobium and cerium and oxides of said metals.

15. The method of claim 1, comprising applying a coating onto a surface of the composite material formed by said micropyretic reaction.

16. The method of claim 15, wherein the component is a cathode and the surface coating comprises a Refractory Hard Metal boride.

17. The method of claim 15, wherein the component is an anode and the surface coating comprises at least one rare earth oxycompound including cerium oxyfluoride.

18. The method of claim 1, further comprising impregnating the operative surface of the component with colloidal ceria, cerium acetate, silica, alumina, yttria, thoria, zirconia, magnesia or lithia and drying the colloid-impregnated component.

19. The method of claim 18, wherein impregnation of the component is followed by a heat treatment and is preferably also preceded by a heat treatment.

20. The method of claim 18 or 19, wherein the impregnation and the drying steps are repeated until the component surface is saturated with the colloid.

21. A cell component of an aluminum production cell which component is made of a composite material comprising at least one ordered aluminide compound of at least one nickel, iron and titanium produced by micropyretic reaction of a dried reaction mixture comprising compacted particulate reactants which react to produce the composite material, bonded by a cerium-based colloidal carrier, the cell component comprising cerium from the colloid dispersed in the aluminide compound, wherein the cerium originating from the colloid ranges from 0.2 to 10% by weight of the composite material.

22. The cell component of claim 21, wherein the composite material comprises nickel aluminide in solid solution with copper.

23. The cell component of claim 21, wherein the composite material comprises a major amount of $Ni_3Al$ and minor amounts of NiAl, nickel, a ternary nickel-aluminium-copper intermetallic compound and $CeO_2$.

24. The cell component of claim 21, wherein the composite material comprises at least one intermetallic compound from the group AlNi, $AlNi_3$, $Al_3Fe$, $AlFe_3$, AlTi and $AlTi_3$ as well as ternary intermetallic compounds derived therefrom, and solid solutions and mixtures of at least one of said intermetallic compounds with at least one of the metals aluminium, nickel, iron, titanium, copper, chromium, manganese, vanadium, molybdenum, zirconium, niobium and cerium and oxides of said metals.

25. The cell component of claim 21, wherein the composite material comprises an intimate mixture of at least one intermetallic compound of nickel-aluminium, at least one intermetallic compound of nickel-aluminium-copper, copper oxide, and a solid solution of at least two of the metals nickel, aluminium and copper.

26. The cell component of claim 21, which is an anode coated with cerium oxyfluoride.

27. The cell component of claim 21, which is a cathode coated with or containing at least one Refractory Hard Metal Boride.

28. The cell component of claim 21, which is impregnated with colloidal ceria, cerium acetate, silica, alumina, yttria, thoria, zirconia, magnesia or lithia.

29. A precursor of a component of an aluminum production cell which is ignitable to produce by micropyretic reaction a cell component made of a composite material comprising at least one ordered aluminide compound of at least one of nickel, iron and titanium, wherein the precursor is formed of a dried reaction mixture comprising compacted particulate reactants which react to produce the composite material, the compacted particulate reactants being mixed with and bonded by a cerium-based colloidal carrier, wherein the cerium originating from the colloid ranges from 0.2 to 10% by weight of the composite material.

30. The precursor of claim 29, wherein the cerium-based colloidal carrier comprises at least one of colloidal ceria and colloidal cerium acetate.

31. The precursor of claim 30, wherein the cerium-based colloidal carrier further comprises at least one of colloidal alumina, yttria, silica, thoria, zirconia, magnesia, lithia or monoaluminium phosphate.

32. The precursor of claim 30, wherein the reaction mixture comprises 50 to 100 parts by weight of at least one of particulate nickel, iron and titanium and 2 to 50 parts by weight of particulate aluminium.

33. The precursor of claim 32, wherein the reaction mixture further comprises 1 to 30 parts by weight of particulate additives selected from copper, chromium, manganese, vanadium, molybdenum, zirconium, niobium and cerium and compounds thereof as well as compounds of aluminium, nickel, iron and titanium.

34. The precursor of claim 33, wherein the reaction mixture comprises 50 to 100 parts by weight of particulate nickel, 2 to 50 parts by weight of particulate aluminium and 1 to 25 parts by weight of particulate copper.

35. The precursor of claim 34, wherein the reaction mixture comprises 50 to 90 parts by weight of particulate nickel, 5 to 30 parts by weight of particulate aluminium, 5 to 25 parts by weight of particulate copper and 0 to 15 parts by weight of additives selected from chromium, manganese, vanadium, molybdenum, zirconium, niobium and cerium and compounds thereof as well as compounds of aluminium, nickel, iron, titanium and copper.

36. The precursor of claim 33, wherein the reaction mixture comprises at least one oxide of at least one metal from the group of aluminium, nickel, copper, chromium, manganese and cerium.

37. The precursor of claim 33, wherein the reaction mixture comprises at least one boride of at least one metal from the group titanium, chromium, vanadium, zirconium, niobium and cerium, or precursors that react to form said borides.

38. The precursor of claim 29, obtained by drying a cerium-based colloidal carrier having a dry colloid content corresponding to up to 50 weight % of the colloidal carrier, preferably from 10 to 20 weight %, there being from 10 to 20 ml of the colloidal carrier per 100 grams of the reaction mixture.

39. The precursor of claim 29, wherein the reaction mixture comprises particulate metals or compounds of metals selected from the group consisting of aluminium, nickel, iron, titanium, copper, chromium, manganese, vanadium, molybdenum, zirconium, niobium and cerium, and mixtures thereof.

40. The precursor of claim 29, wherein the composite material comprises at least one intermetallic compound from the group AlNi, $AlNi_3$, $Al_3Fe$, $AlFe_3$, AlTi and $AlTi_3$ as well as ternary intermetallic compounds derived therefrom, and solid solutions and mixtures of at least one of said intermetallic compounds with at least one of the metals aluminium, nickel, iron, titanium, copper, chromium, manganese, vanadium, molybdenum, zirconium, niobium and cerium and oxides of said metals.

* * * * *

UNITED STATES PATENT AND TRADEMARK OFFICE

CERTIFICATE OF CORRECTION

PATENT NO. : 5,720,860
DATED : Feb. 24, 1998
INVENTOR(S) : Sekhar et al.

It is certified that error appears in the above-identified patent and that said Letters Patent is hereby corrected as shown below:

Column 7, line 65, please change "direct" to --dried--.

Signed and Sealed this

Twenty-first Day of April, 1998

Bruce Lehman

*Attest:*

BRUCE LEHMAN

*Attesting Officer*

*Commissioner of Patents and Trademarks*